US005204202A

United States Patent [19]

Ishikawa et al.

[11] Patent Number: 5,204,202

[45] Date of Patent: Apr. 20, 1993

[54] ELECTROPHOTOGRAPHIC PHOTOSENSITIVE ELEMENT COMPRISING A PROTECTIVE LAYER WITH A POROUS SURFACE IMPREGNATED WITH LUBRICANT

[75] Inventors: Fuminori Ishikawa, Hitachiohta; Kunihiro Tamahashi, Mito; Shigeharu Onuma; Masatoshi Wakagi, both of Hitachi; Masanobu Hanazono, Mito; Mitsuyoshi Shoji, Ibaraki; Takayuki Nakakawaji, Hitachi; Yutaka Ito, Takahagi; Shigeki Komatsuzaki, Mito; Chiaki Yamabishi, Hitachi, all of Japan

[73] Assignees: Hitachi, Ltd.; Hitachi Chemical Co., Ltd., both of Tokyo, Japan

[21] Appl. No.: 494,527

[22] Filed: Mar. 16, 1990

[30] Foreign Application Priority Data

Mar. 18, 1989 [JP] Japan ..... 1-66777

[51] Int. Cl.[5] ..... G03G 5/082; G03G 5/14

[52] U.S. Cl. ..... 430/66; 430/58

[58] Field of Search ..... 430/66, 58

[56] References Cited

U.S. PATENT DOCUMENTS 3,830,648 8/1974 Rutherford et al. ..... 430/119
4,647,521 3/1987 Oguchi et al. ..... 430/66
4,859,554 8/1989 Yamazaki et al. ..... 430/66

FOREIGN PATENT DOCUMENTS 0264902 3/1989 European Pat. Off. .

OTHER PUBLICATIONS

Patent Abstracts of Japan, vol. 13, No. 261.

*Primary Examiner*—Marion E. McCamish
*Assistant Examiner*—S. Rosasco
*Attorney, Agent, or Firm*—Antonelli, Terry Stout & Kraus

[57] ABSTRACT

An electrophotographic photosensitive element, e.g. for a photocopier or laser printer, comprises a substrate and a plurality of layers on the substrate including a photoconductive layer of a-Si:H and a protective and lubricating layer which is outermost from said substrate. To provide wear resistance and long life-time of the protective and lubricating layer, this layer comprises a microporous solid material having a pore structure which extends substantially over the whole thickness of the material and a hydrophobic lubricant carried by said solid material. The lubricant includes a liquid film and often times a non-particulate solid film, and provides at least part of the outer surface of the element and is present also in the pores of said microporous solid material.

23 Claims, 4 Drawing Sheets

ELECTROPHOTOGRAPHIC PHOTOSENSITIVE ELEMENT COMPRISING A PROTECTIVE LAYER WITH A POROUS SURFACE IMPREGNATED WITH LUBRICANT

BACKGROUND OF THE INVENTION

1. FIELD OF THE INVENTION

The present invention relates to an electrophotographic photosensitive element, a method of making such an element, electrophotographic apparatus including such an element and use of such apparatus. The invention particularly aims to provide an electrophotographic photosensitive element suitable for forming an excellent image even if used for printing in conditions of high humidity. Typically, the invention is applied to the electrophotographic element, e.g. drum, of an electrophotographic printer, such as a laser beam printer or a LED printer or a photocopier.

2. DESCRIPTION OF THE PRIOR ART

Electrophotographic photosensitive elements used in the prior art are exemplified by an inorganic photoconductive material such as Se, CdS or $As_2Se_3$, or an organic photoconductive material as represented by a pigment of phthalocyanine.

These materials have excellent characteristics in respect of photosensitivity and charge acceptance but have the defect of short lifetime because their film hardness is too low to give a sufficient wear resistance. In contrast, an amorphous silicon photosensitive element is hard enough to achieve a long life time.

However, the amorphous silicon photosensitive element has the defect of inferior moisture resistance. It is, therefore, the current practice to form a surface protecting layer of a-SiC:H (amorphous SiC containing hydrogen) or a-SiN:H, which however is not sufficient to solve the problem that image blur occurs especially in high moisture conditions after repeated printing over a long time period.

This problem is thought to occur because the surface of the a-Si:H photosensitive element is oxidized by the corona discharge in the printing process of the electrophotography, which reduces its moisture resistance. In order to prevent this, it is necessary to use a chemically stable material as the surface protecting layer.

For example, there have been proposed a a-C:H:F:film as desclosed in Japanese Patent Application No. 62-22361, a thermoplastic resin film as disclosed in Japanese Laid-Open Patent Specification No. 55-70848, and a method using film a containing methyl silicon resin or a resin containing a fluorine compound as disclosed in Japanese Laid-Open Patent Specification No. 62-206559. These techniques are effective in improving the moisture resistance and the corona resistance but suffer from reduced wear resistance and cleanability.

Japanese Laid-Open Patent Specifications 64-56447, 64-56448, 64-56449 and 64-56450 describe a photosensitive element for copying machines and laser printers having a-Si:H photoconductive layer and a dense surface protective layer thereon. The outer face of the surface layer has considerable surface unevenness generated during its deposition, which is due at least partly to the unnevenness of the layer below. The surface indentations or cavities thus formed contain lubricant, e.g. hydrophobic lubricant, in the form of particles or in Japanese Laid-Open Patent Specification 64-56450 of melted and resolidified thermoplastic resin powder which may contain lubricant particles. The protective layer is made for example of a-SiC:H, $Al_2O_3$ or high-resistivity polymer and may be 0.01–10 μm thick.

The prior art thus far described cannot simultaneously satisfy the several requirements for the surface protecting layer of an electrophotographic photosensitive member, for example, moisture resistance, corona resistance, wear resistance and cleanability.

SUMMARY OF THE INVENTION

An object of the present invention is to provide a photosensitive element which has a surface protecting layer of excellent moisture resistance even after repeated application of electrostatic charges such as the corona charges, and excellent wear resistance and cleanability.

According to the invention, there is provided an electrophotographic photosensitive element comprising a substrate and a plurality of layers on said substrate, said layers comprising a photoconductive layer and a protective and lubricating layer which is outermost from said substrate. The protective and lubricating layer comprises a microporous solid material having a pore structure which extends substantially over the whole thickness of the material and a hydrophobic lubricant carried by said solid material. The lubricant comprises at least one of a liquid film and a non-particulate solid film, preferably a continuous film, and provides at least part of the outer surface of the element and is present also in the pores of said microporous solid material. The lubricant film thus provides good lubricating properties at the surface and also can exude or become available from the pores during use of the element.

Preferably the lubricant is at least partly located on said microporous solid material by at least one of chemical bonding and molecular embedding. Chemical bonding is discussed at length below. Molecular embedding may be molecular chain entrapment or chain entanglement.

All of the lubricant may be located, i.e. immobile, but is preferred that it is partly located and partly mobile on the microporous solid material. All of the lubricant may be mobile on the microporous solid material. The lubricant may include solid particles.

It has been found that friction properties are improved when the protective and lubricating layer is formed directly on a smooth surface, e.g. a surface of the photoconductive layer. Preferred is a smooth surface having a surface roughness of not more than 0.1 microns.

Preferably the pore structure of the microphorous solid material comprises interconnected pores, desirably having a ratio of depth to size of at least 2, preferably in the range 2 to 10. The porosity is preferably 10 to 50% by volume, more preferably 20 to 50% by volume.

The pore size is desirably not greater than 1 micron, preferably not more than 0.5 microns, and may be not more than half the thickness of the protective and lubricating layer, preferably not more than half said thickness.

The thickness of the protective and lubricating layer may suitably be not more than 1 micron.

Resistance to wear can be improved if the microporous solid material contains particulate inorganic filler, as discussed more below.

The invention also provides electrophotographic apparatus comprising:

(i) a photosensitive element of the invention as described above,
(ii) means for forming electrophotographically an electrostatic latent image on said photosensitive element,
(iii) means for developing said latent image and fixing the developed image on a medium.

The means for developing the latent image, e.g. toner, preferably comprises a powder having a particle size which is at least 10 times the pore size of the microporous solid material.

With the present invention, there can be achieved an electrophotographic process in which a photosensitive element, e.g. a drum or belt, is driven at a high circumferential speed and can be started without any preheating. It is possible to operate the process, even under conditions of high humidity, without positive temperature control of the element.

Thus the photosensitive element may be stated substantially from room temperature and may operate at a surface speed of at least 12 m/min, for example 65 m/min or more.

In contrast with the protective layers of JP-A-64-56447-50 described above, the protective and lubricating layer of the present invention is microporous and has a porosity extending through its full thickness. The hydrophobic lubricant is a generally continuous liquid or solid film which provides the outer surface of the layer and is present in the pores of the microporous material. As a result, the lubricating property of the outer surface is improved and a large store of lubricant is available. Wear-resistance and life-time are consequently improved. Especially preferred is the embodiment of the present invention in which the lubricant is partly fixed in place on the microporous material and partly mobile.

In the apparatus of the present invention, conventional technology may be used for electrostatic charging, for electrostatic latent image forming, for developing of the latent image and for fixing.

In another aspect, the invention provides and electrophotographic photosensitive element comprising a substrate and on the substrate a photoconductive layer and a protective and lubricating layer which comprises a microporous solid material and hydrophobic lubricant carried by the solid material, the lubricant being at least partly located by at least one of chemical bonding and molecular embedding.

In yet another aspect, the invention provides an electrophotographic photosensitive element comprising a substrate and on the substrate a photoconductive layer and a protective and lubricating layer which comprises a microporous solid material containing particulate inorganic filler and a hydrophobic lubricant carried by the microporous solid material.

The invention also provides an electrophotographic photosensitive element comprising a substrate and on the substrate a photoconductive layer and a protective and lubricating layer which comprises a microporous solid material layer and a hydrophobic lubricant carried by said microporous solid material layer, the protective and lubricating layer being formed on a surface having a surface roughness of not more than 0.1 microns.

The photoconductive material of the photoconductive layer of the element of the present invention may be amorphous silicon, metallic or non-metallic phthalocyanine, selenium or another known material and may be applied to at least one of amorphous silicon, amorphous carbon, amorphous silicon carbide and amorphous silicon nitride layers. The invention is especially advantageous when the photoconductive layer is amorphous silicon, e.g. amorphous silicon containing hydrogen (a-Si:H).

The protective and lubricating layer is required to withstand the frictional wear during the running of the electrophotographic apparatus, such as the friction with the toner and the carrier and the friction with the fur brush for removing the residual toner. The layer may be formed of an inorganic or organic substance or a combination. To achieve high oxidation and abrasion resistance, a material cured at high temperature is preferred.

In the case of an inorganic substance such as a ceramic, a continuous thin ceramic layer may be formed directly over the photoconductive layer or on an intermediate layer and may be formed with pores by etching or anodizing.

The formation of the pores in an organic layer may be accomplished by mixing a suitable additive into a solution which is a precursor for the organic layer and by removing the additive after application of the solution. The method of removal may be selected from pyrolysis, volatilization and elution, and the additive used is suitably selected in accordance with the method. In the case of using pyrolysis, the additive used may be a polymer which will decompose at 300° C. or less so as to avoid deterioration of the characteristics of the photosensitive element. Decomposition at 250° C. or less is preferred.

This pyrolytic polymer can be exemplified by liquid paraffin, randam copolymer of isobutylene and normal butylene, polytetramethylene-ether-glycol, polytetramethylene glycol, polyoxyethylene-polyoxypropylen copolymer and polyvinylmethylether.

When no additive is used, on the other hand, the micro-pores can be formed by using a foaming resin or by hot baking an organic film being set.

The fine pores formed in the surface protective and lubricating layer, i.e. the micro-pores, have the effect of holding the surface lubricant for a long period and supplying the hydrophobic lubricant slowly to the surface. This gives water-repellency, corona resistance and lubrication to the surface of the photosensitive element. These micro-pores are preferably airpermeable, i.e. are open and form continuous network so that they may be impregnated with the lubricant while allowing it to be released to the surface.

The size of the micro-pores is generally preferred to be 0.001 microns or more, especially 0.01 to 5 microns and is most preferably not more than 1 micron, e.g. within a range of 0.1 to 1 micron. The pore size may be selected such that it prevents any invasion of the toner used. Preferably the toner has a particle size of at least 10 times this pore size.

The microporous solid material to be used in the present invention for forming a porous, organic protective and lubricating film is not limited but may desirably be a cured material partially or wholly cross-linked during curing. The curing temperature is preferably 300° C. or lower, desirably 250° C. or less. In order to prevent image blur, it is preferred to use a material having a high surface resistivity, desirably at least $10^{12}$ ohms.cm.

For example, epoxy resin, phenol resin, styrene resin, polyester resin, polyimide resin, polyamide resin or the like may be used as this material.

The electrophotographic photosensitive element is subjected to wear during the printing process by for example the developer, the paper and the cleaning brush.

In order to withstand the printing of 1 to 10 million pages, the surface protective and lubricating layer of the photosensitive element is required to have a high wear resistance. For this requirement, it is desirable to raise the mechanical strength of an organic layer. For this reason, the microporous organic layer may have dispersed in it an inorganic filler, e.g. particle of fibre. The particle size of this inorganic filler may be suitably selected in accordance with the thickness of the organic layer. A size larger than the layer thickness can be more effective for improving the mechanical strength.

The inorganic filler can be exemplified by silica, alumina, quartz, kaolin, mica, talc, hydrated alumina, potassium titanate, iron powder, asbestos, clay, wollastonite, zinc oxide, silicon carbide, silicon nitride, diamond, boron and boron nitride.

If the surface of this inorganic substance is surface-treated to bond chemically using an organo-metallic compound (e.g. organo-silicon compound) before it is dispersed in the organic layer, its matching with the organic layer can be improved, to give higher mechanical strength.

As the lubricant for covering the protective layer surface and present in the micro-pores, there may be mixed in advance into the material of the layer a hydrophilic substance such as an oxide of zirconium, a metal sulfide such as molybdenum sulfide, fine powder of teflon or fine powder of other fluorocarbon compounds.

There will now be described particularly preferred fluorine-containing lubricants which can be used in conjunction with an organic microporous material to form the lubricating protective layer of the invention.

The fluorine lubricant used to give the water-repellency to the surface layer of the photosensitive element is desirably solid at room temperature but may be liquid. Desirable lubricants are those having perfluoropolyoxyalkyl groups or perfluoropolyoxyalkylene groups, e.g. as expressed by the following general formula:

$$F(C_3F_6-O-)_x-C_2F_4-;$$

$$F(C_3F_6-O-)_x-(CF_2O)_y-(CF_2)_z-; \text{ or}$$

$$-[(C_2F_4O)_y-(CF_2O)_z-CF_2]-,$$

(wherein x, y and z each designate an integer of 1 or more, desirably x=5 or more; y=10 to 25; and z=10 to 56).

The above-specified fluorine compounds are for example comercially available as Krytox 143 of Du Pont or Fomblin Y or Z of Montefluos/Montedison.

In order to suppress the disappearance of the lubricant due to wear for a long time in the printer, it is effective to bind the lubricant chemically to the solid microporous material. This may be done partly, leaving some lubricant unbound. The lubricant molecule may have at its end a group reactive with the organic microporous layer. For example, it is highly effective to use a fluorine reaction fixed type lubricant having a silanol group or an isocyanate group in the case where the organic film is epoxy. The lubricant having the silanol group is exemplified by a chemical compound which is expressed by one of the following general formulae:

$$Rf-R_1-R_2-Si(R_3)_m$$

$$[Rf]-[R_1-R_2-Si(R_3)_m]_2$$

(wherein Rf designates the aforementioned perfluoropolyoxyalkyl group or perfluoropolyoxyalkylene group; $R_1$ designates —CONH—, —COO— or —$C_2$-HO—; $R_2$ designates an alkylene group having 2 to 4 carbon atoms; $R_3$ designates an oxyalkylene group having 1 to 3 carbon atoms; and m designates an integer of 1 to 3.

The compound can be more specifically exemplified by the formulae:

$$Rf-CONH-C_3H_6-Si(OC_2H_5)_3$$

$$Rf-CONH-C_3H_6-Si(OCH_3)_3$$

$$Rf-CONH-C_3H_6-\overset{\overset{CH_3}{|}}{Si}(OCH_3)_2$$

$$Rf-COO-C_3H_6-Si(OC_2H_5)_3$$

$$Rf-CH_2O-C_2H_4-Si(OCH_3)_3$$

$$Si(OC_2H_5)_3-C_3H_6-NHCO-Rf-CONH-C_3H_6-Si(OCH_3)_3$$

(wherein Rf designates the perfluoropolyoxyalkyl group or perfluoropoly-oxyalkylene group).

The above-specified compound is applied to the organic film and heated at 100° C. to 200° C. for 1 to 2 hours so that its silanol reacts with the organic layer to form an siloxy bond (—Si—O—) until it is bound to the film surface.

A lubricant having an isocyanate group can be exemplified by the following general formulae:

$$Rf-R-(R')_j-(NCO)_n$$

$$[Rf]-[R-(R')_j-(NCO)_n]_2$$

(wherein Rf designates the perfluoropolyoxylalkyl group or perfluoropoly-oxyalkylene group; R designates —CONH—, —OCONH— or —$CH_2$OCONH—; R' designates a saturated di- or tri-valent hydrocarbon group having 5 to 20 carbon atoms, or a di- or tri-valent aromatic hydrocarbon group, as specified below:

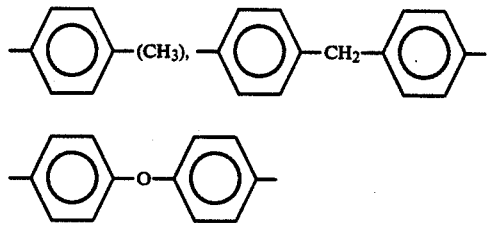

j designates an integer larger than 0, preferably 1; and n designates 1 or 2); or

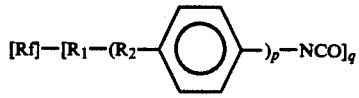

(wherein: $R_1$ designates a direct bond or —$CH_2$—, —CO— or an amide linkage; $R_2$ designates a direct bond, ester linkage, amide linkage or $—OC_eH_{2e}—$ and may be different in every repetition; p designates an integer of 1 to 3; and q and r each designate 1 or 2).

The isocynate group at the end is masked by a phenol such as phenol or cresol, primary amine or alcohol. The isocyanate is unmasked, when heated to 100° to 200° C., to react with epoxy group so that it chemically reacts with an epoxy compound through an oxazoridone ring. The heat treatment time may be 1 to 2 hours.

The surface layer of the photosensitive element including the lubricant may have a higher water-repellency than that of the porous material of the surface layer. If the surface layer is made of an epoxy resin, for example, the water-repellency may be 65 degrees or more in terms of the contact angle of water.

The lubricant may be composed of a first chemically fixed lubricant and a second lubricant, e.g. a fluorine lubricant, having no reaction group. If both lubricants have fluorine chains, they have excellent affinity, improving their wear resistance.

Moreover, the microporous material, particularly an organic material, may be impregnated, when being formed, with the fluorine lubricant. In this case, the fluorine lubricant to be used may desirably have at its end a non-fluorine containing group having a high affinity with the organic material, e.g. such as is expressed by the following general formulae:

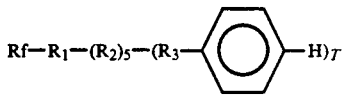

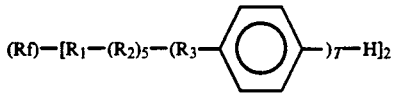

(wherein: Rf designates the aforementioned perfluoropolyoxyalkyl group or perfluoropolyoxyalkylene group; $R_1$ designates a direct bond, $—CH_2—$, —CO— or —CONH—; $R_2$ designates an oxyalkylene group having 2 or 3 carbon atoms; $R_3$ designates a direct bond, —O—, —COO—, —CONH—, —NHCO—, $—OC_kH_{2k}—$ or $—C(CH_3)_2—$ and may be different for each repetition; s designates an integer of 0 or more; T designates an integer of 1 or more; and k designates an integer of 1 or 2).

The above-specified lubricant and the organic resin are dissolved in a solvent and are applied to the photosensitive element. Then, during the evaporation of the solvent, the fluorine chain of the perfluoropolyoxyalkyl group or perfluoropolyoxyalkylene group of the lubricant is separated out to the surface of the organic layer, whereas the non-fluorine containing group is left in the layer so that the lubricant is fixed on the film surface. At the instant when the fluorine chain is separated out to the surface, the micro pores are not formed. In this case, it is necessary to form the micro pores through predetermined steps and to provide the lubricant layer impregnating the pores.

Next, an example of a process for forming the organic layer having the micro pores on the surface of the a-Si:H photosensitive layer preferred in the invention will be described. The method of forming the a-Si:H photosensitive element may be suitably selected from plasma CVD, sputtering, reactive evaporation, photo CVD and magnetron CVD.

First, a suitable known three-dimensional setting resin or thermoset resin is dissolved together with an additive for forming the micro-pores such as a pyrolytic polymer in a good organic solvent such as a mixture of methyl-ethyl-ketone, butyl cellosolve acetate and trifluoro-trichloroethane. If an inorganic substance is to be dispersed in the organic layer, the inorganic substance to be added to the solution and mixed by a ball mill. The surface of the inorganic substance may be coupled in advance with an organometallic compound as mentioned above. Then, the fluorine lubricant having a non-fluorine containing group having a high affinity with the above-specified organic material may be mixed into the solution. After this, a film of the solution is formed on the surface of the photosensitive element. The method of forming this film may be suitably selected from dipping or spin-coating.

After this, the solvent is evaporated by a heat treatment at 80° C. to 120° C. for 0.5 to 2 hours. At this stage, groups containing fluorine chains are separated to the film surface when the fluorine lubricant is present, whereas the non-fluorine containing groups are left in the organic layer. Next, the crosslinking of the organic layer is promoted to complete the formation of the organic film by a heat treatment at 180° C. to 300° C. for 1 to 3 hours. By the heat treatment at this stage, the pyrolytic polymer is decomposed and evaporated to form the micro pores in the organic material.

A lubricant film is formed over the organic film thus formed. First of all, a solution is prepared by mixing or dissolving the hydrophobic lubricant. Ball mill mixing is employed, if necessary, in the case of the inorganic oxide or the metal sulfide. If the fluorine lubricant is used, it is dissolved in trifluorotrichloroethane, for example. The film of this solution is formed over the organic material by a method similar to that used for forming the organic layer. After this, a heat treatment at 100° C. to 200° C. is carried out for 1 to 2 hours to cause evaporation of the solvent (and reaction of the lubricant when a reactive lubricant is used), thereby to complete the lubricant film. Another lubricant film may be formed by repeating similar steps.

The total thickness of the protective and lubricating layer of the present invention is preferably less than 10 microns more preferably not more than 1 micron. An excessive thickness would deteriorate the residual potential of the photosensitive element.

In order to enhance the effect of the surface layer of the present invention, moreover, it is effective to apply the same lubricant as that used in the lubricant layer on the other parts of the electrophotographic apparatus which contact the photosensitive element, e.g. the developer or fur brush.

The electrophotographic photosensitive element of the present invention thus has a surface layer made of the microporous material which is impregnated with the water-repelling lubricant, so that it has highly improved moisture and corona resistance. Since the lubricant forms at least part of the outer surface of the layer, the photo-sensitive element has excellent wear-resistance. Moreover, the lubricant on the microporous material contributes to reduction in the friction coefficient of the surface of the photosensitive element so that its cleanability is excellent.

An a-Si:H (amorphous silicon) photosensitive element has the problem that the contrast potential (i.e. the difference between the charging potential and potential after exposure) falls, deteriorating the printing quality, after printing a number of sheets, if the circumferential speed of the photosensitive drum is increased. This problem can be avoided by using the surface protective and lubricating layer of the present invention.

As a result, it is possible, particularly when using an amorphous silicon photoconductive layer, to provide an electrophotographic apparatus, which can be started instantly from the room or ordinary temperature without preheating of the photosensitive element and in which the photosensitive element can be driven at a circumferential speed of at least 12 m/min and even 65 m/min or more.

The amorphous silicon photosensitive element of the prior art has to be preheated by a heater thereby to repel the water content which might otherwise be adsorbed or caught by the surface, because of its surface properties of adsorbing water. This preheating step is eliminated by the present invention.

By the present invention, the photosensitive element is improved, to provide high speed electrophotography in which the circumferential speed is raised to about 65 m/min. This speed corresponds to a speed of about 20,000 lines per min. A photosensitive drum having a diameter of 26 cm (and a width of 40 cm) can be made, using the invention.

BRIEF DESCRIPTION OF THE DRAWINGS

Examples of the invention are given below, with reference to the accompanying drawings. The examples are not limitative of the invention. In the drawings.

DETAILED DESCRIPTION OF THE PREFERRED EMBODIMENTS

Example 1

Figure 1:
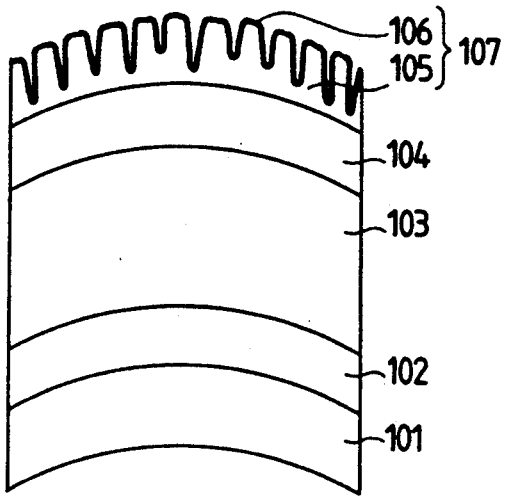
FIG. 1 is a sectional view showing the a-Si:H photosensitive element of on embodiment of the present invention.

This example of the present invention will be described in the following with reference to FIG. 1 which shows the layer structure of an a-Si:H photosensitive element embodying the present invention. The substrate is a tube 101 of aluminium (only part of the circumference of this tube is shown in section in FIG. 1) having a diameter of 120 mm and a length of 300 mm. On this tube 101 there were sequentially formed, in a plasma CVD reactor using a high frequency of 13.56 MHz, (i) an a-SiC:H:B blocking layer 102 from a mixture gas of monosilane, ethylene, diborane and hydrogen;

(ii) an a-Si:H:B photosensitive layer 103 from a mixture gas of monosilane, diborane and hydrogen; and (iii) an a-SiC:H covering layer 104 from monosilane, ethylene and hydrogen. The film thicknesses were: 2 microns for the blocking layer 102; 30 microns for the photosensitive layer 103; and 0.5 microns for the covering layer 104.

Next, the photosensitive element thus prepared was taken out from the plasma CVD reactor and coated with an organic film. The solution applied was prepared by dissolving into 1,350 g of methyl ethyl ketone 57 g of epoxy resin precursor, 93 g of phenol-formaldehyde resin precursor and 0.57 g of triethylammonium caliborate

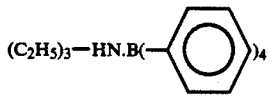

followed by adding thereto 37.5 g polytetramethylene ether glycol (PTMEG) or a pyrolitic polymer. The above-specified a-Si:H photosensitive element was dipped in the solution thus prepared, to form a film. After this, the solution was evaporated by preheating at 100° C. for 1 hour, followed by a heat treatment of 230° C. for 2 hours to set the organic film and evaporate the PTMEG, thus completing an organic film 105 having micro-pores. It was confirmed by an electric microscope that the film thickness was 0.2 microns and that the average size of the micro pores was about 0.2 microns. FIG. 1 shows only surface pores, but the film 105 has a bulk porosity. The pores are fully interconnected, and extend over the full thickness of the film.

Subsequently, the a-Si:H photosensitive element having the organic film 105 was dipped in a lubricant application liquid which consisted of 10 g of Krytox 143AZ of Du Pont dissolved into 1,496 g of trifluoro-trichloroethane as solvent. After dipping, the solvent was evaporated by a heat treatment of 100° C. for 30 minutes, to complete a lubricant layer 106 extending within the pores of the film 105 and forming the outer surface of the film 105. The film 105 and lubricant 106 constitute an impregnated type organic surface protecting and lubricating layer 107.

Figure 6:
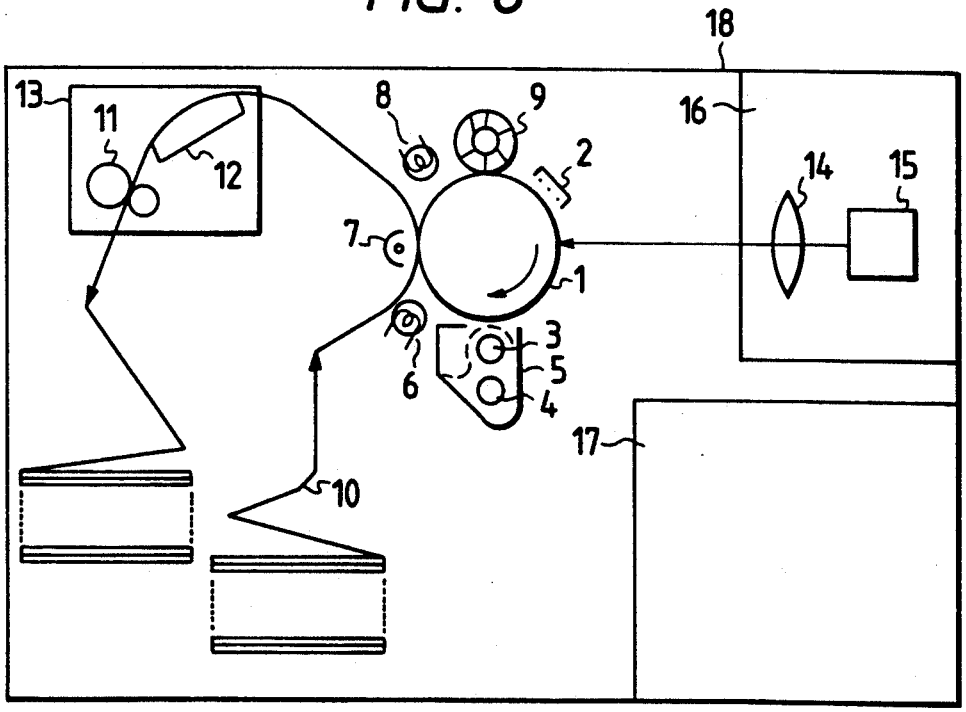
FIG. 6 is a schematic diagram showing the sturcture of an electrophotographic apparatus to which the present invention is applied.

The photosensitive element thus prepared was installed as the photosensitive drum in a laser beam printer 18 shown in FIG. 6, to evaluate the relationship of the number of prints made and the humidity resistance in terms of the contact angle of water.

In the printer of FIG. 6, there are arranged a charger 2 for applying electrostatic charges to the photosensitive drum 1 and an optical system 16 composed of a light source 15 providing an electromagnetic signal such as a light for exposure and a lens 14. The electrostatic latent image formed on the surface of the photosensitive element of the drum is caused to contact with a developer, i.e. the toner and carrier 5, which is agitated by a magnetic roll 4, so that it is developed.

The drum is irradiated with a fade lamp 6 to erase the potential of the portion left unexposed. Next, a recording medium e.g. printing paper 10, is caused to contact the drum so that it has the developed image transferred thereto by charging a transfer charger 7.

The drum is irradiated by an erase lamp 8 and is cleaned by a cleaner 9 for the subsequent step.

The toner image transferred to the paper 10 is fixed through a fixing device 12 having a preheate 12 and a heat roll 11. Here, the printer 18 is equipped with a necessary power source 17. This printer is freed from any blur of the image obtained, even if it is started without any preheat, and can accomplish its printing operations at a high speed.

Figure 2:
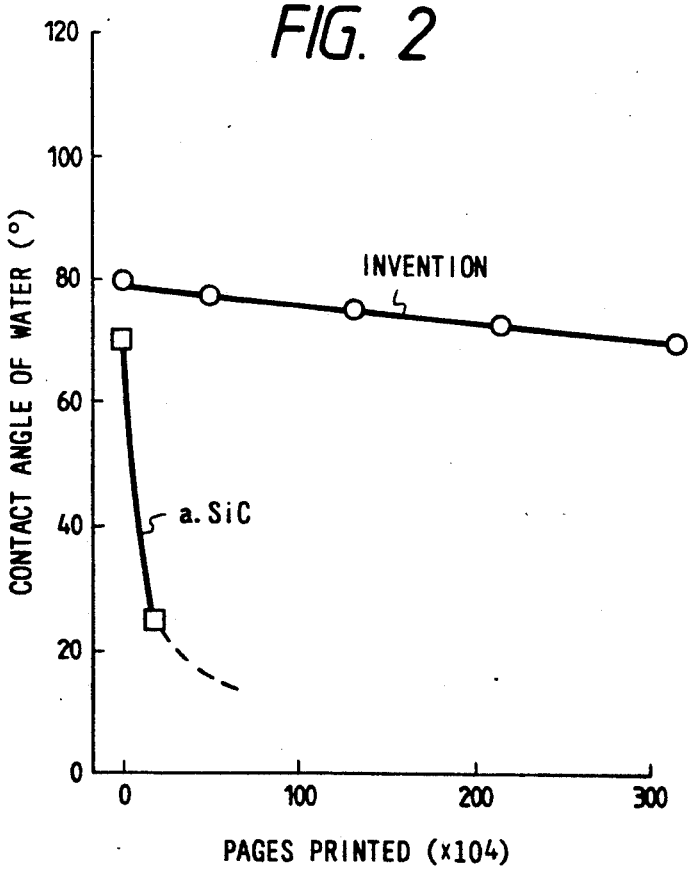
FIG. 2 is a graph of the contact angle of water of a-Si:H photosensitive elements plotted against the number of prints made.

The results of the investigations of the characteristics of the photosensitive element are shown in FIG. 2.

As the Comparison 1, there is plotted the results obtained with a photosensitive element which was prepared like that of Example 1 but without the impregnated organic surface protecting and lubricating layer 107.

The photosensitive element according to the present invention had its contact angle substantially unchanged even after printing of 3 million pages and exhibited an excellent humidity resistance so that it caused no image blur even after printing at 20° C. and under the condition of a humidity of 80% or less. As compared with this, the photosensitive element of Comparison 1 not having the impregnated organic surface layer 107 suffered reduction of its contact angle to 25 degrees after printing of about 150 thousand sheets so that image blur occurred when printing at 20° C. and in humidity of 60% or less.

Figure 3:
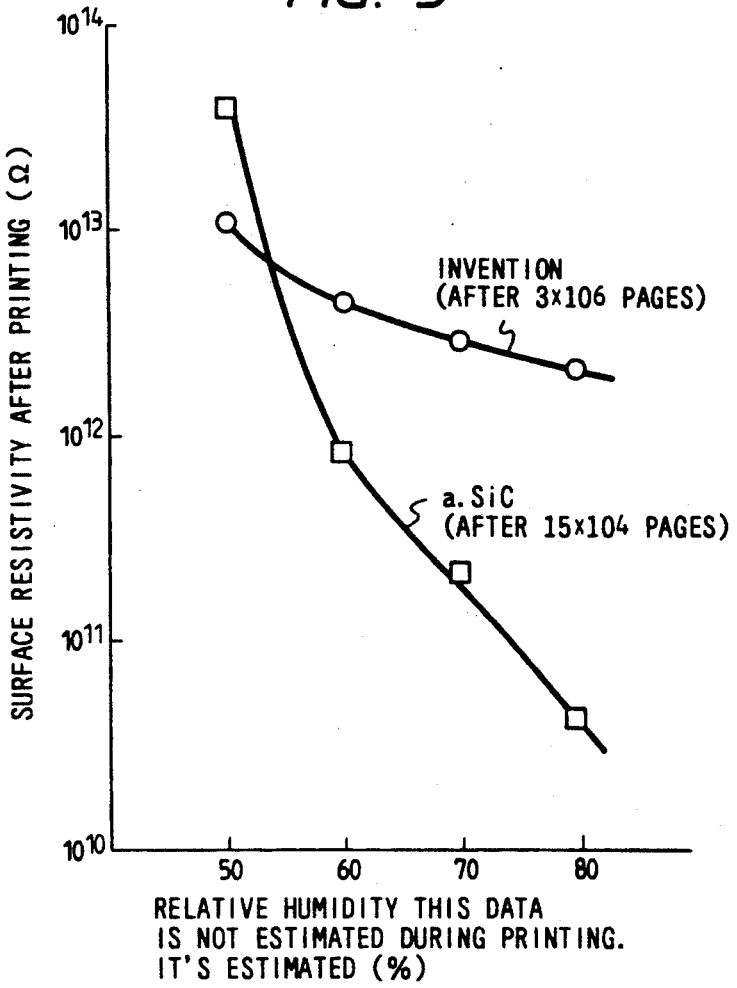
FIG. 3 is a graph of the surface resistivity of a-Si:H photosensitive elements after the printing tests against the relative humidity.

FIG. 3 plots the results of measurements of the surface resistivity after the printing tests, for Example 1 and Comparison 1.

The element of Example 1 had a surface resistivity of $10^{12}$ ohms or more at a relative humidity or 80%. In contrast the element of Comparison 1 had a resistivity of $10^{13}$ ohms or more in relative humidity of 50% or less and a resistivity of $10^{12}$ ohms or less in relative humidity of 60% or more. It was found that the impregnated type organic protecting and lubricating layer according to the present invention gave excellent humidity resistance even after the printing of 3 million pages.

Figure 7:
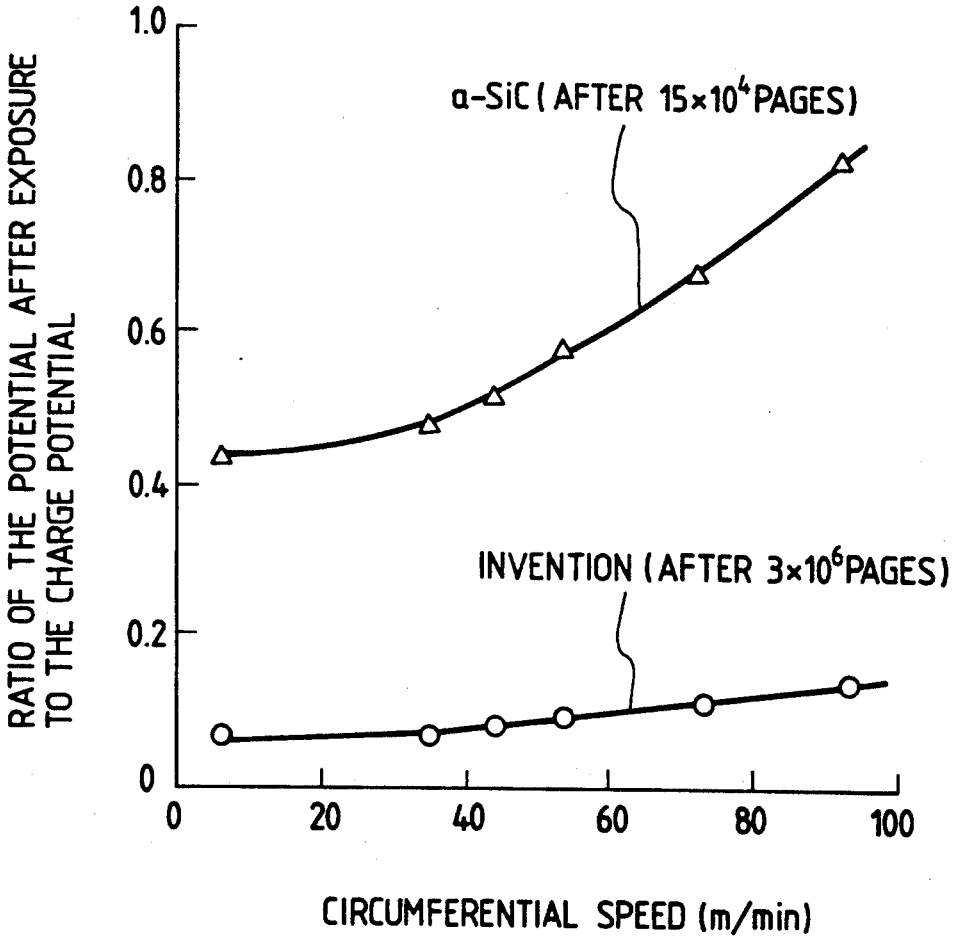
FIG. 7 is a graph of the relation between the circumferential speed of the photosensitive element and the charging/exposure potential ratio.

FIG. 7 plots the results of measurements of the ratio of the potential after exposure to the charge potential in relative humidity of 60% after the printing tests, using the circumferential speed of the photosensitive element as the parameter. It is found that the element of Example 1 has a potential ratio as low as 0.15 even for the circumferential speed of 100 m/min so that it can achieve a sufficient contrast potential, whereas the element of Comparison 1 has a potential ratio exceeding 0.4 for the circumferential speed of 5 m/min so that it has a low contrast potential.

Example 2

Figure 4:
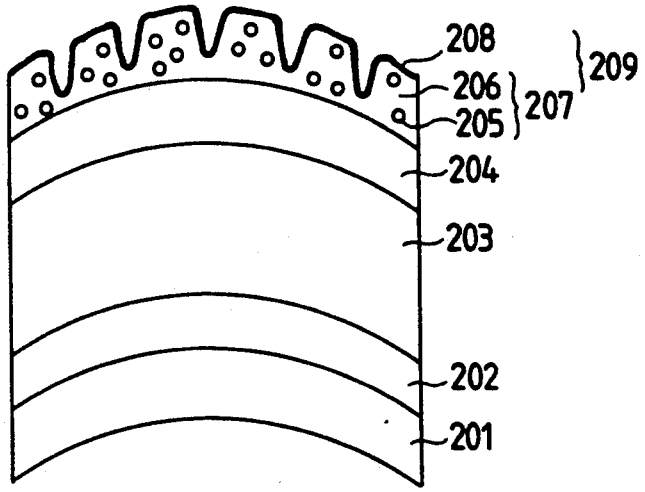
FIGS. 4 and 5 are sectional views showing the a-Si:H photosensitive elements according to other embodiments.

Another Example of the present invention will be described with reference to FIG. 4. As in Example 1, a tube 201 of aluminium (having a diameter of 120 and a length of 300) is laminated by a-Si films 202 to 204 to prepare a three-layered a-Si:H photosensitive element.

Next, the same organic film as in Example 1 was applied to the photosensitive element. However, the liquid applied additionally was mixed with 15 g of an alpha-$Al_2O_3$ filler having an average particle diameter of 0.06 microns. The $Al_2O_3$ filler particles had been coupled in advance with 3-glycidoxypropyltrimethoxysilane so as to increase afffinity with the resin of the organic film. This application liquid was kneaded by a ball mill to disperse the $Al_2O_3$ uniformly. The film of the application liquid was formed on the a-Si:H photosensitive element and was subjected to a heat treatment similar to that of the Example 1, to complete a microporous filler dispersion type organic film 207. Next, a lubricant layer 208 similar to that of the Example 1 to complete an impregnated type organic surface protecting and lubricating layer 209.

Print resistance tests were carried out using a printer similar to that of the Example 1. Effects similar to those of the Example 1 were obtained, but the contact angle of water after the printing of 3 million pages was about 75 degrees, which was higher by about 5 degrees than that of Example 1.

Example 3

Figure 5:
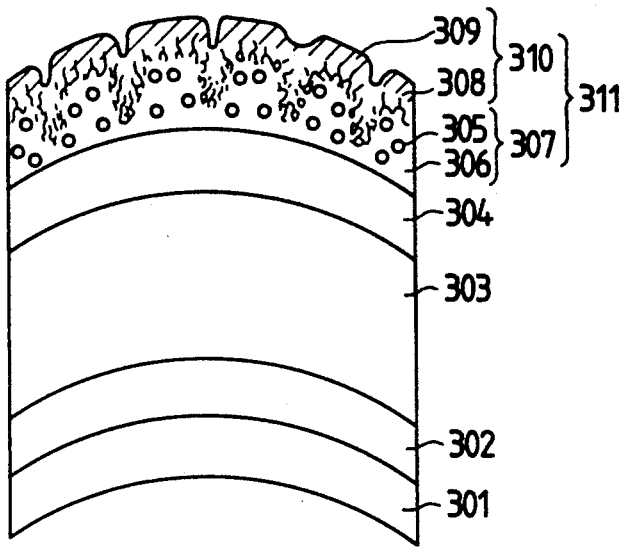

FIG. 5 is a diagram showing the structure of the photoconductive element according to another embodiment of the present invention.

As in Example 2, a filler dispersed type microporous organic film 307 was formed over a photosensitive layer on a tube 301 of aluminium (having a diameter of 120 mm and a length of 300 mm). This photosensitive element was dipped in an application liquid which had been prepared by dissolving, into 1495 g of fluon solvent, 5 g of fluorine reaction type lubricant, as expressed by the following chemical formula:

$$Rf—CONH—C_3H_6—Si(OC_2H_5)_3$$

(wherein: Rf designates $F[CF(CF_3)—CF_2O—]_nCF(CF_3)—$; n designates an average value of 14). After this, the organic film 307 was subjected to a heat treatment of 150° C. for 1 hour to fix a fluorine reaction fixed type lubricant 308 in the pores and over the surface of the filler dispersion type microporous organic film 307. This lubricant was thus chemically bound to the organic film 307.

Then, a free or unbound lubricant layer 309 like that of the Examples 1 and 2 was formed in the same manner as in Examples 1 and 2 to form a two layered lubricant layer 310, to complete the impregnation type organic surface protecting and lubricating layer 311.

This photosensitive element was subjected to the printing tests like those of the Example 1 and 2. The initial water contact angle was about 100 degrees, and the contact angle after printing of 3 million pages was about 85 degrees. Thus, the water-repellency was higher than those of the first and second Examples, and the problem of the image blur did not arise.

Example 4

The filler 205 of Example 2 was replaced by an alpha-$Al_2O_3$ filler having an average diameter of 0.3 microns to prepare a similar photosensitive element. Effects similar to those of Example 2 were obtained.

Example 5

A photosensitive element was prepared like the Example 2 except that the application liquid for forming the filler dispersion type organic film 207 of the Example 2 was replaced by an application liquid, which was prepared by dissolving, into 1.125 g of methyl ethyl ketone, 150 g of butyl acetate cellosolve and 75 g of trifluoro-trichloroethane as solvent, 57 g of epoxy resin precursor, 93 g of phenol-formaldehyde resin precursor, 0.6 g of triethylammonium caliborate, 37.5 g of polytetramethylene-ether-glycol and 3 g of a lubricant expressed by the following formula:

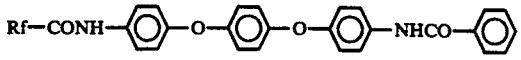

(wherein: Rf designates $F[CF(CF_3)—CF_2O—]_nCF(CF_3)—$; n designates an average value of 14); and by mixing into the solution alpha-$Al_2O_3$ filler having an average particle diameter of 0.06 microns. There could be attained effects similar to those of Example 2.

Example 6

On a substrate tube 101 of aluminum (having a diameter of 120 mm and a length of 300 mm) were laminated a-Si films 102 to 104 to prepare a three layered a-Si:H photosensitive element.

Next, the organic film was applied to the photosensitive element by coating a solution which was prepared by dissolving into 1,260 g of methyl ethyl ketone 91.2 g of epoxy resin, 148.8 g of phenol resin and 0.912 g of triethylammonium caliborate

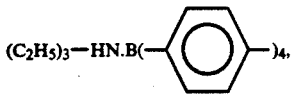

followed by adding thereto 60 g of polytetramethylene ether glycol (PTMEG, average molecular weight 1000) which is a pyrolytic polymer. The above-specified a-Si:H photosensitive element was dipped in the solution thus prepared, to form the film. The drawing-up speed of the element from the solution was 1 mm/sec. After this, the solution was evaporated by preheating at 100° C. for 1 hour, followed by a heat treatment at 215° C. for 2 hours to set the organic film and evaporate the PTMEG, thus completing an organic film 105 having micropores. It was confirmed by an electronic microscope that the thickness of the organic film was 0.3 microns and the average diameter of the micropores was about 0.1 microns, the average depth of the micropores was about 0.25 microns.

Subsequently, the a-Si:H photosensitive element having the organic film 105 was dipped in liquid which consisted of 33 g of Krytox 157 FSL by dissolved into 1,467 g of trifluoro trichloro ethane to form a lubricant solution. After applying the solution, trifluoro trichloro ethane was evaporated by a heat treatment at 100° C. for 30 minutes, to complete a lubricant layer and an impregnated type organic surface protecting layer.

Printing tests were conducted by using a printer similar to that of the Example 1. It was confirmed that it caused no image blurring probelem even after the printing of 3 million pages.

Example 7

To the organic solution of Example 6 added was 72 g of powder of alpha-$Al_2O_3$ having an average particle diameter of 0.4 microns. After the application of the solution to the surface of the element, a lubricant layer and an impregnated type organic surface protecting layer were formed in the same manner as in Example 6. Effects similar to that of Example 6 were confirmed.

To summarise, the surface protecting and lubricating layer of the photosensitive element of the present invention can have such an excellent water-repellency that its initial value is little changed even after the printing of 3 million pages, and can maintain its surface resistivity as high as $10^{12}$ ohms or more even in a high relative humidity of 80%. Especially, the a-Si:H photosensitive element of the present invention is free from the problem of image blur even after a large amount of printing so that it can have a long lifetime. When, moreover, an amorphous silicon photosensitive layer is used, the electrophotographic apparatus can be started without any preheating, and temperature control during operation is not required.

What is claimed is:

1. An electrophotographic photosensitive element comprising a substrate and provided thereon at least a photoconductive layer and a protective and lubricating layer, with said protective and lubricating layer providing an outermost surface of the element, said protective and lubricating layer comprising a solid film having a number of fine pores and a water-repellent lubricant having perfluoropolyoxyalkyl groups or perfluoropolyoxyalkylene groups impregnated into said pores and covering a surface of said solid film, said water-repellent lubricant being a liquid film that exudes from the pores to the outermost surface; the thickness of the protective and lubricating layer being not greater than 1 micron and greater than the depth of the pores.

2. An element according to claim 1 wherein said lubricant further includes solid particles.

3. An element according to claim 1 wherein said lubricant includes a non-particulate solid film that is at least partly immobilized on said solid film by at least one of chemical bonding and molecular embedding.

4. An element according to claim 3 wherein said liquid film is mobile on said solid film.

5. An element according to claim 1 wherein said lubricant is at least partly mobile on said solid film.

6. An element according to claim 1 wherein said protective and lubricating layer is formed directly on a smooth surface.

7. An element according to claim 6 wherein said smooth surface has a surface roughness of not more than 0.1 microns.

8. An element according to claim 1 wherein said pore structure of said solid film comprises interconnected pores.

9. An element according to claim 1 wherein the pores of said solid film have a ratio of depth to size of at least 2.

10. An element according to claim 1 wherein said solid film has a porosity of 10 to 50% by volume.

11. An element according to claim 1 wherein the pores of said solid film have pore size of not greater than 1 micron.

12. An element according to claim 11 wherein said pore size is less than half the thickness of said protective and lubricating layer.

13. An element according to claim 1 wherein said solid film comprises a cross-linked organic polymer.

14. An element according to claim 13 wherein said solid film contains particulate inorganic filler.

15. An element according to claim 1 wherein said lubricant comprises at least one fluorocarbon compound.

16. An element according to claim 1 wherein said photoconductive layer is an amorphous silicon layer.

17. An electrophotographic photosensitive element comprising a substrate and provided thereon at least a photoconductive layer and a protective and lubricating layer, with said protective and lubricating layer providing an outermost surface of the element, said protective and lubricating layer comprising a microporous solid film having a number of fine pores and a water-repellent lubricant having perfluoropolyoxyalkyl groups or perfluoropolyoxyalkylene groups impregnated into said pores and covering a surface of said solid film, said water-repellent lubricant comprising a liquid film and a non-particulate solid film, said non-particulate solid film being immobilized through chemical linkage or implantation on the surface of said microporous solid film and said liquid film being impregnated into said pores and exuding from the pores to the outermost surface; the thickness of the protective and lubricating layer being not greater than 1 micron and greater than the depth of the pores.

18. An element according to claim 17 wherein said liquid film is mobile on said microporous solid film.

19. An element according to claim 17 wherein said microporous solid film has pores which are at least partly interconnected and constitute a pore structure extending over substantially the whole thickness of said microporous solid film.

20. An electrophotographic photosensitive element comprising a substrate and provided thereon at least a photoconductive layer and a protective and lubricating layer, with said protective and lubricating layer providing an outermost surface of said element, said protective and lubricating layer comprising a solid film having a number of fine pores including a particulate inorganic filler and a water-repellent lubricant having perfluoropolyoxyalkyl groups or perfluoropolyoxyalkylene groups impregnated into said pores and covering a surface of said solid film; said water-repellent lubricant comprising a liquid film that exudes from the pores to the outermost surface and the thickness of the protective and lubricating layer being not greater than 1 micron and greater than the depth of the pores.

21. An element according to claim 20 wherein said solid film comprises a cross-linked organic polymer.

22. An element according to claim 20 wherein said inorganic filler has a particle size of not less than the thickness of said solid film.

23. An electrophotographic photosensitive element comprising a substrate and provided thereon at least a photoconductive layer and a protective and lubricating layer, with said protective and lubricating layer providing an outermost surface of the element, said protective and lubricating layer comprising a solid film having a surface roughness of not more than 0.1 $\mu$m and a number of fine pores and a water-repellent lubricant having perfluoropolyoxyalkyl groups or perfluoropolyoxyalkylene groups impregnated into said pores and covering a surface of said solid film, said water-repellent lubricant comprising a liquid film that exudes from the pores to the outermost surface; the thickness of the protective and lubricating layer being not greater than 1 micron and greater than the depth of the pores.

* * * * *